US009382030B2

(12) United States Patent
Miranda et al.

(10) Patent No.: US 9,382,030 B2
(45) Date of Patent: Jul. 5, 2016

(54) ADJUSTABLE DISPLAY TRAY

(71) Applicant: INTERNATIONAL PAPER COMPANY, Memphis, TN (US)

(72) Inventors: German Adiel Miranda, Rogers, AR (US); Alan Keith Reische, Charlotte, NC (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 378 days.

(21) Appl. No.: 14/087,909

(22) Filed: Nov. 22, 2013

(65) Prior Publication Data

US 2015/0144686 A1 May 28, 2015

(51) Int. Cl.

| | |
|---|---|
| ***B65D 5/355*** | (2006.01) |
| ***B65D 5/20*** | (2006.01) |
| ***B65D 5/22*** | (2006.01) |
| ***B65D 5/52*** | (2006.01) |

(52) U.S. Cl.

CPC ..... *B65D 5/0005* (2013.01); *B65D 5/2047* (2013.01); *B65D 5/22* (2013.01); *B65D 5/5246* (2013.01)

(58) Field of Classification Search

CPC ..... B65D 5/0005; B65D 5/2042; B65D 5/22; B65D 5/5246; A47F 1/04; A47F 1/125; A47F 2005/0075

USPC ..... 206/736, 774, 745; 229/101, 101.1, 229/101.2

See application file for complete search history.

(56) References Cited

U.S. PATENT DOCUMENTS

| | | | | |
|---|---|---|---|---|
| 1,939,744 | A | 12/1933 | Wellman | |
| 2,919,060 | A | 12/1959 | Daniels | |
| 2,975,954 | A | 3/1961 | Sparks | |
| 3,154,052 | A | 10/1964 | Sweeney | |
| 3,170,618 | A | 2/1965 | Sweeney | |
| 3,251,532 | A | 5/1966 | Hechtman et al. | |
| 3,310,220 | A | 3/1967 | Feldman | |
| 3,598,303 | A * | 8/1971 | Folz | B65D 5/4266 229/101 |
| 3,886,901 | A * | 6/1975 | Zeitter | A01K 1/0125 119/168 |
| 3,904,106 | A * | 9/1975 | Elder | B65D 5/248 229/149 |
| 4,253,602 | A * | 3/1981 | Kulig | B65D 5/2047 229/171 |
| 5,590,788 | A | 1/1997 | Inman | |
| 5,645,212 | A * | 7/1997 | Potter | B65D 5/64 229/101 |
| 6,386,371 | B1 * | 5/2002 | Parsons | B65D 5/5246 206/485 |
| 6,454,107 | B1 * | 9/2002 | Belanger | B65D 5/724 206/556 |
| 6,676,009 | B1 | 1/2004 | Rose | |

(Continued)

FOREIGN PATENT DOCUMENTS

| | | |
|---|---|---|
| EP | 0741658 | 12/1998 |
| GB | 2206563 | 1/1989 |

*Primary Examiner* — Steven A. Reynolds
(74) *Attorney, Agent, or Firm* — Matthew M. Eslami

(57) ABSTRACT

An adjustable display tray includes a bottom wall, opposite side walls, a front wall and a back wall foldably joined to one another to form an open-top adjustable interior space for containing articles. The adjustable interior space includes a central section formed by two parallel spaced apart fold lines on the bottom wall and respective central portions of the front wall and back wall. Respective first and second reducible and expandable sections foldably extend from the respective two parallel spaced apart fold lines. Each of the respective first and second reducible and expandable sections include a respective tray front hinge and a respective back swing flap which are formed on the respective front and the back walls to permit the respective first and second reducible and expandable sections to be configured to reduce or expand the interior space of the adjustable display tray.

13 Claims, 5 Drawing Sheets

(56) References Cited

U.S. PATENT DOCUMENTS 6,808,107 B2 10/2004 Jackson
7,172,110 B2 2/2007 Jackson
7,784,617 B2 * 8/2010 Urban ..... B65D 5/2038 206/45.25
2007/0284422 A1 * 12/2007 Saunders ..... B65D 5/0005 229/101

* cited by examiner

ADJUSTABLE DISPLAY TRAY

FIELD OF THE INVENTION

This invention generally relates to display trays and more particularly, to a corrugated adjustable display tray that contains product at the point of sale for display and access to the product within the tray.

BACKGROUND OF THE INVENTION

Various types of trays have been formed from corrugated paperboard in the past for use in packaging and shipping different kinds of merchandise. Such trays are generally cut from a flat corrugated sheet and are then folded along score lines to form a tray for containing various goods. Since these type of the display trays can be quickly constructed in a retail store, the display trays of this type is generally known as a "PDQ" (Pretty Darn Quick). Retail stores prefer a means to facilitate secondary placement of promotional product as off-shelf pallet displays reached the end of their sell cycle. Thus, they want a tray that could be removed from the pallet and then placed on a 24", 30", or 36" fixture shelf. Historically, PDQ trays have relied on extendable graphic panels to fill remaining shelf space; however, retailers do not want to take up valuable shelf space with graphic panels. They want a tray that had the ability to "expand" in order to hold additional product.

Accordingly, there is need for an adjustable display tray which is capable of expanding and contracting so as to provide a retailer with the flexibility of using the expandable tray as a stock-keeping unit in an expanded or a contracted configuration.

SUMMARY OF THE INVENTION

The present invention is directed to an adjustable display tray or expandable PDQ tray which is capable of expanding or contracting so as to provide a retailer with the flexibility of using the adjustable display tray as a stock-keeping unit in an expanded or a contracted configuration. Retailers prefer a means to facilitate secondary placement of promotional product as off-shelf pallet displays reached the end of their sell cycle. They want a tray that could be removed from the pallet and then placed on a 24", 30", or 36" fixture shelf. In general, expandable PDQ trays have relied on extendable graphic panels to fill remaining shelf space; however, retailers do not want to take up their valuable shelf space with graphic panels. They want a tray that had the ability to expand in order to hold additional product. The flexible nature of this expandable tray represents potential tooling and inventory savings.

Accordingly, the one aspect of the present invention is directed to an adjustable display tray comprises a bottom wall, opposite side walls, a front wall and a back wall foldably joined to one another to form an open-top adjustable interior space for containing articles. The adjustable interior space includes a central section formed by two parallel spaced apart fold lines on the bottom wall and respective central portions of the front wall and back wall. Respective first and second reducible or expandable sections foldably extend from the respective two parallel spaced apart fold lines. Each of the respective first and second reducible or expandable sections includes a respective tray front hinge and a respective back swing flap which are formed on the respective front and the back walls to permit the respective first and second reducible or expandable sections reducing or expanding the interior space of the adjustable display tray.

Another aspect of the present invention is directed to an adjustable display tray capable of being converted from an expanded position to a contracted position. The adjustable display tray comprises a bottom wall having two parallel spaced apart fold lines and opposite side walls are foldably joined to respective lateral edges of the bottom wall. A front wall is foldably joined to first longitudinal edge of the bottom wall. The front wall includes two spaced apart tray front hinges formed thereto. A back wall is foldably joined to second longitudinal edge of the bottom wall and being defined by an inner back panel and an outer back panel foldably joined to one another. The inner back panel includes two lateral parallel spaced apart score lines to form two back swing flaps and the outer back panels includes two outer exterior flaps and in which the bottom wall, opposite side walls, the front wall and the back wall foldably joined to one another to form an open-top adjustable interior space for containing articles. The adjustable interior space includes a central section formed by the two parallel spaced apart fold lines and respective central portions of the front wall and back wall. Respective first and second reducible or expandable sections are formed by the two parallel spaced apart fold lines, the two respective tray front hinges, the two respective back swing flaps and the two respective outer exterior flaps all of which engage with one another to permit the respective first and second reducible or expandable sections reducing or expanding the interior space of the adjustable display tray.

A further aspect of the present invention is directed to a blank for making an adjustable display tray capable of being converted from an expanded position to a contracted position. The blank comprises a bottom wall panel having two parallel spaced apart fold lines and two space apart slots formed in proximity of the respective spaced apart fold lines. Opposite side walls panels are foldably joined to respective lateral edges of the bottom wall panel. A front wall panel foldably joined to a first longitudinal edge of the bottom wall panel and being defined by two an inner front panel and an outer front panel that are foldably joined to one another. The inner front wall panel includes two triangular-shaped fold lines each of which forms a tray front hinges. A back wall panel is foldably joined to a second longitudinal edge of the bottom wall. The back wall is defined by an inner back panel and an outer back panel foldably joined to one another in which the inner back panel includes two lateral parallel spaced apart score lines to form two back swing flaps and the outer back panels includes two outer exterior flaps. A central section panel is formed by the two parallel spaced apart fold lines and respective central portions of the front wall panels and back wall panels. Respective first and second reducible or expandable section panels are formed by the two parallel spaced apart fold lines, the two respective tray front hinges, the two respective back swing flaps and the two respective outer exterior flaps, all of which engage with one another to permit the respective first and second reducible or expandable sections to contract or to expand the adjustable display tray.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
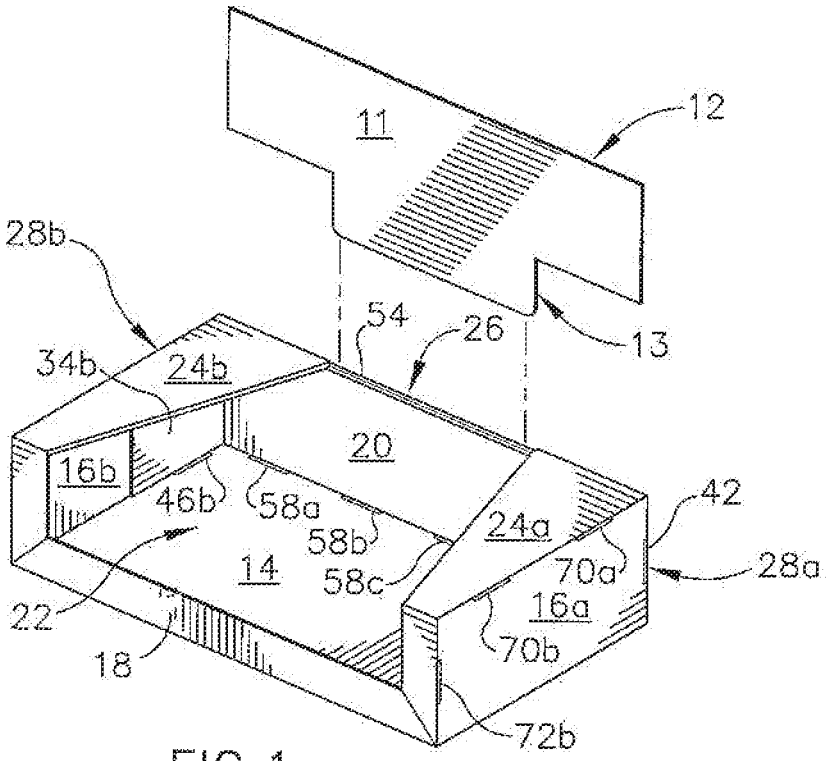
FIG. 1 is an exploded top perspective view of an adjustable display tray having a graphic header positioned in a spaced relationship thereof in accordance to a preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same. In addition, the adjustable display tray or expandable display tray are used interchangeably.

Figure 2:
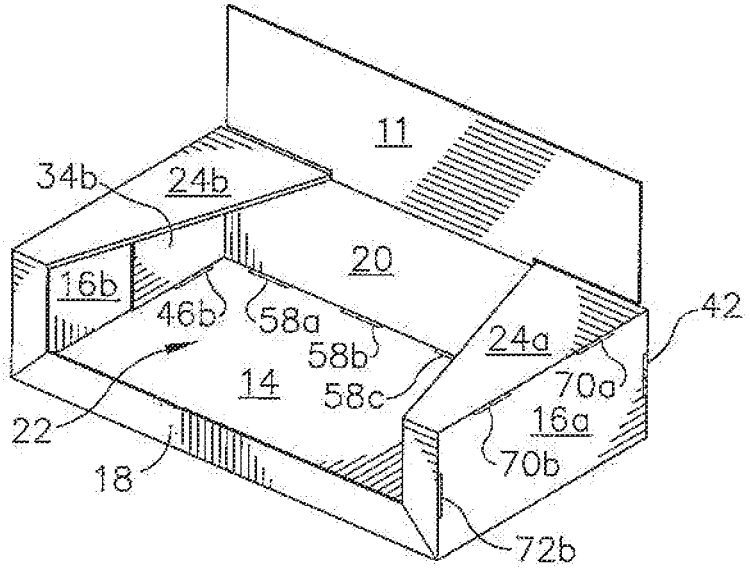
FIG. 2 is a top perspective view of the expandable tray of FIG. 1 with the graphic header engaged with the expandable tray in accordance to a preferred embodiment of the invention.
Figure 3:
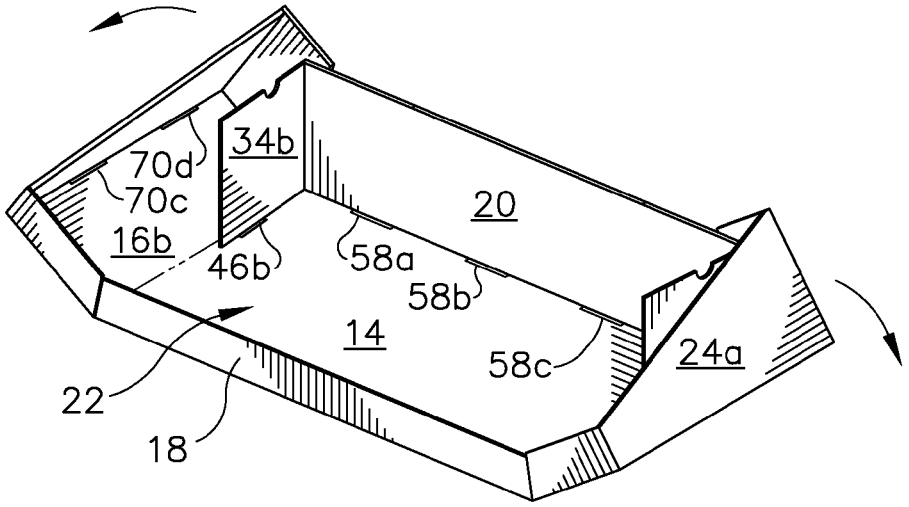
FIG. 3 is a top perspective view of the expandable tray of FIG. 1 in a partially expanded configuration.
Figure 4:
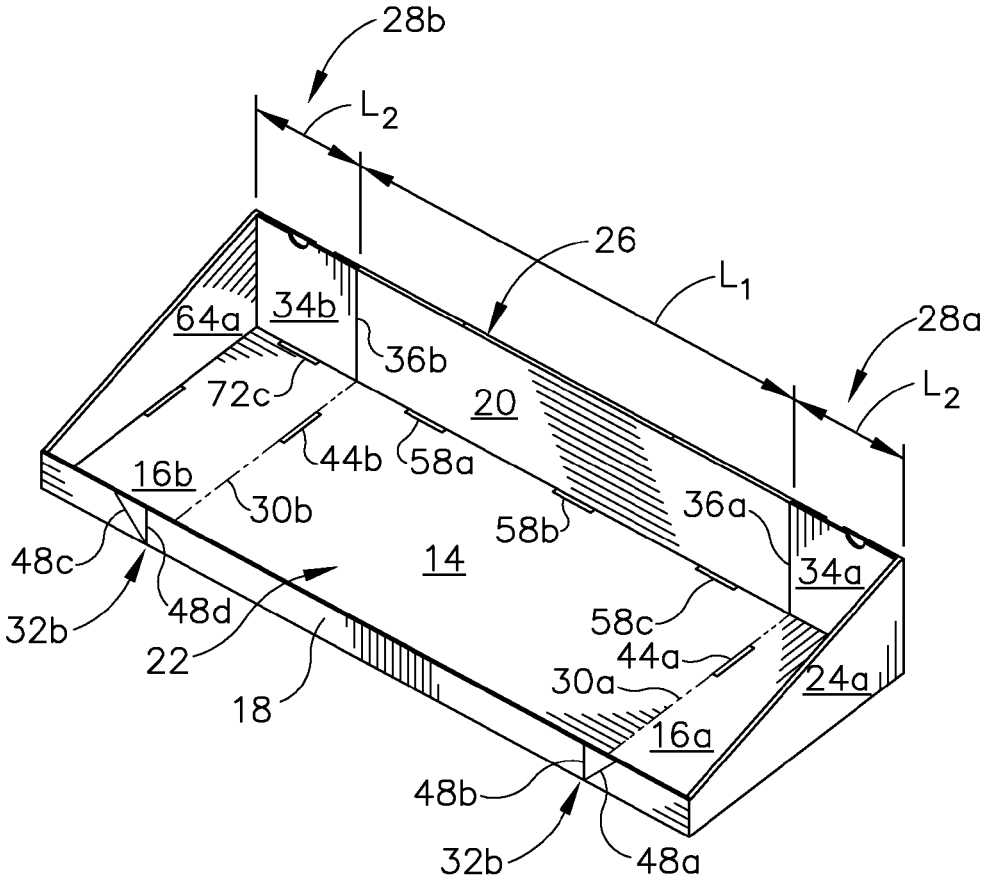
FIG. 4 illustrates the top perspective view of the expandable tray of FIG. 3 in a fully expanded configuration.

FIG. 1 is an exploded top perspective view of an adjustable display tray 10 having a graphic header 12 positioned in a spaced relationship thereof in accordance to a preferred embodiment of the invention. The adjustable display tray 10 or the expandable PDQ tray is capable of expanding or contracting so as to provide a retailer with the flexibility of using the adjustable display tray 10 as a stock-keeping unit in an expanded or a contracted configuration. FIGS. 1 and 2 depict the adjustable display tray 10 in a reducible or contracted configuration and FIG. 4 depicts the adjustable display tray 10 in a fully expanded configuration. In the reducible configuration, the adjustable display tray 10 includes a bottom wall 14, opposite side walls 16*a*, 16*b*, a front wall 18 and a back wall 20 foldably joined to one another to form an open-top adjustable interior space 22 to receive various products or articles. The center portion of the front wall 18 is defined by a respective inner and outer front panels 18*a*, 18*b* (shown in FIG. 7) foldably joined to one another and the back wall 20 is defined by a respective inner and outer back panels 20*a*, 20*b* (also shown in FIG. 7) foldably joined to one another as will be discussed in greater detail hereinafter. The adjustable display tray 10 forms two partial top closures 24*a*, 24*b* which are foldably joined to the respective side walls 16*a*, 16*b* when in Contacted configuration. It should be noted that when the adjustable display tray 10 is in fully expanded configuration, the side walls 16*a*, 16*b* are foldably part of the bottom wall 14 and the partial top closures 24*a*, 24*b* are the side walls 24*a*, 24*b* of the adjustable display tray 10. Each of the opposite side walls 24*a*, 24*b* or partial top closures partially cover the open-top of adjustable interior space 22 when the display tray is in a reducible configuration. The graphic header 12 includes a header panel 11 having an insert tab 13 integrally extends from one of its longitudinal free edges. The insert tab 13 is engaged with the adjustable display tray 10 as will be described in greater detail hereinafter.

Figure 6:
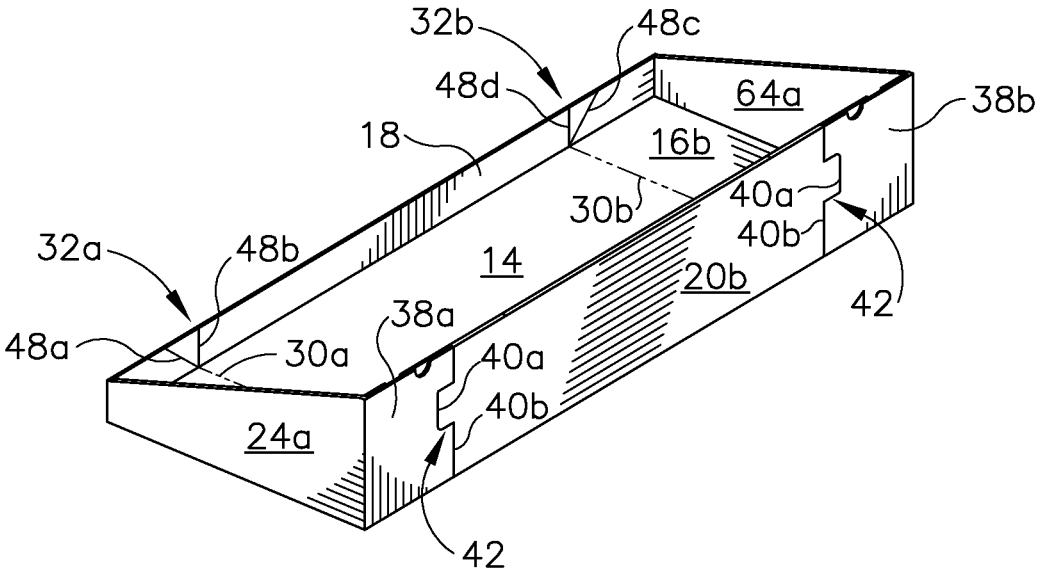
FIG. 6 depicts a back view of the expandable tray of FIG. 4.

As depicted best in FIG. 4, in the expanded configuration, the adjustable display tray 10 defines by three sections, namely, a central section 26 and two respective first and second reducible or expandable sections 28*a*, 28*b* foldably joined to one another. The central section 26 is formed by two parallel spaced apart fold lines 30*a*, 30*b* on the bottom wall 14 and the respective central portions of the front wall 18 and the back wall 20. Each of the respective first and second reducible or expandable sections 28*a*, 28*b* foldably extends from the respective two parallel spaced apart fold lines 30*a*, 30*b*. The central section 26 has a length (L1) which is at least two or three times longer than the respective length (L2) of each of the first and second reducible or expandable sections 28*a*, 28*b*. The back wall 20 has a height (H) and the front wall 18 has a height (h) in which the height (h) of the front wall 18 is less than the height (H) of the back wall 20 so as to allow for ease in viewing of the articles placed in the adjustable display tray 10. The inner back panel 20*a* of the back wall 20 includes two lateral parallel spaced apart score lines 36*a*, 36*b* to form each of the back swing flaps 34*a*, 34*b*. Each of the respective back swing flaps 34*a*, 34*b* swings at right angle with respect to the score lines 36*a*, 36*b* toward inside of the interior space 22 so that each of them engages with the bottom wall 14. As seen best in FIG. 6, the outer back panel 20*b* includes two outer exterior flaps 38*a*, 38*b* each of which formed by combination of a respective U-shaped cut 40*a* and nicks 40*b*. In this example, there are three nicks 40*b*, but there may be two or four or any other number of nicks 40*b*. The two respective outer exterior flaps 38*a*, 38*b* and the two respective back swing flaps 34*a*, 34*b* are in registry with one another when the adjustable display tray 10 is in the expanded configuration. However, when the adjustable display tray 10 is in reducible configuration, the two respective back swing flaps 34*a*, 34*b* and the two respective outer exterior flaps 38*a*, 38*b* are perpendicular to one another. It should be noted that the respective lateral edges of the center portion of the back wall 20 includes a first locking tab 42 formed by the respective U-shaped cut of each of the respective outer exterior flaps 38*a*, 38*b*. Each of the first locking tabs 42 is inserted into the corresponding slots 72*a* and 72*c* as in FIGS. 1, 2, and 7.

Each of the respective first and second reducible or expandable sections 28*a*, 28*b* includes two respective tray front hinges 32*a*, 32*b* and two respective back swing flaps 34*a*, 34*b* which are formed on the respective front and the back walls 18, 20 to permit the respective first and second reducible or expandable sections 28*a*, 28*b* reducing or expanding the interior space 22 of the adjustable display tray 10. The central section 26 includes two slots 44*a*, 44*b* each of which is formed on proximate of the respective two parallel spaced apart fold lines 30*a*, 30*b*. Each of the back swing flaps 34*a*, 34*b* includes a second locking tab 46*a*, 46*b* each of which is inserted into the respective slots 44*a*, 44*b* on the central section 26. The respective second locking tabs 46*a*, 46*b* are formed on the respective bottom free edges of the back swing flaps 34*a*, 34*b* when in folded position. The respective tray front hinges 32*a*, 32*b* are triangular in shape and formed by respective two fold lines 48*a*, 48*b*, 48*c*, and 48*d*.

Figure 7:
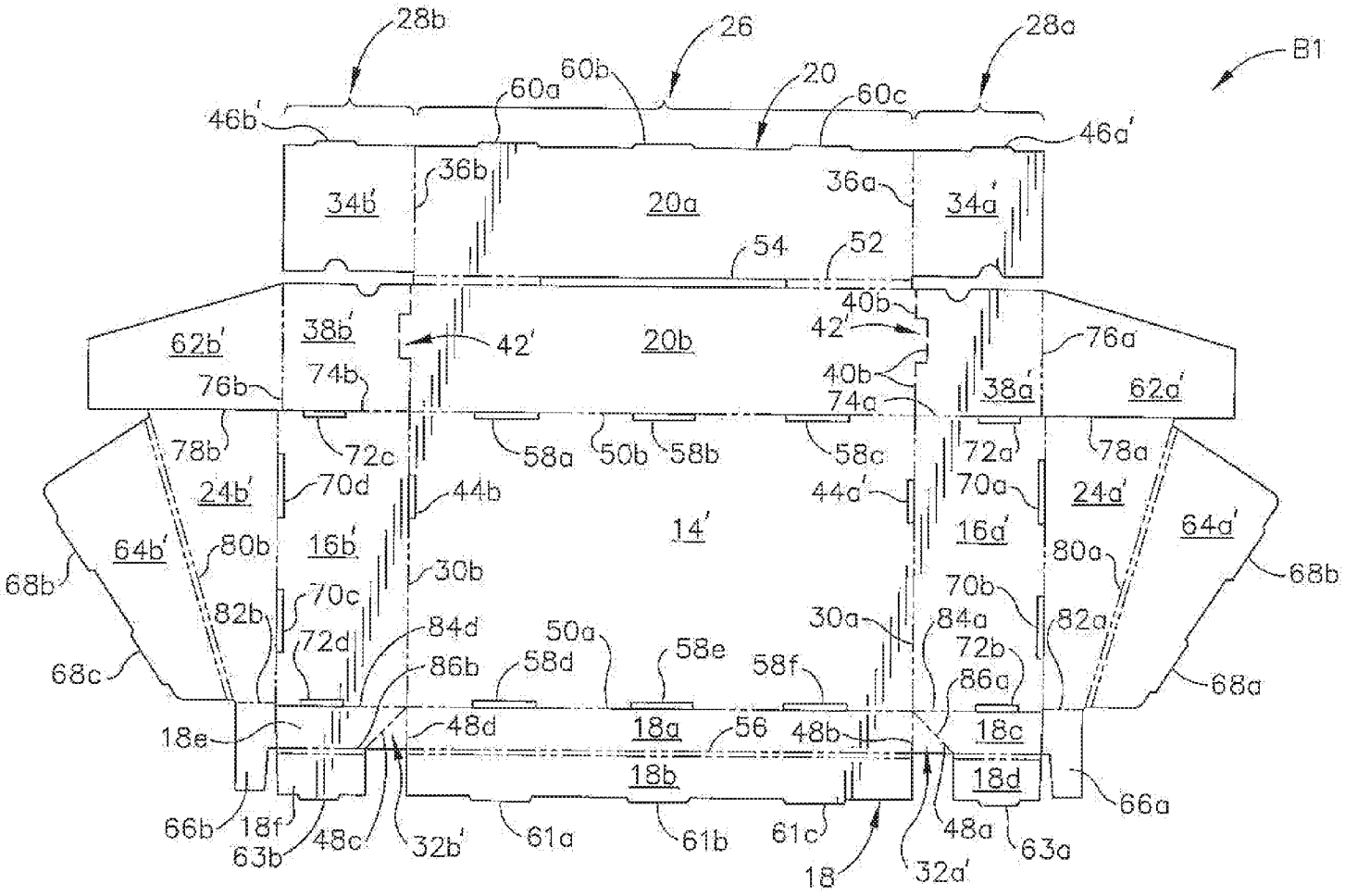
FIG. 7 is a top plan view of a one-piece blank for making the expandable tray of FIG. 1 in accordance to a preferred embodiment of the invention.

FIG. 7 is a top plan view of a one-piece blank B1 for making the expandable display tray 10 of FIG. 1 in accordance to a preferred embodiment of the invention. The blank B1 is substantially flat symmetrical with respect to its lateral axis thereof. The blank B1 is preferably an integral piece of a material such as continuous sheet of conventional corrugated paperboard. The blank B1 is cut along its outer margins to form its specific shape. The blank B1 is foldably divided into a central section 26 and first and second reducible or expandable sections 28*a*', 28*b*' by two parallel fold lines 30*a*, 30*b*. The first and second reducible or expandable sections 28*a*, 28*b* are mirror images of one another with respect to the lateral axis of the blank B1. The central section 26 comprises the bottom wall panel 14', the respective outer and inner back wall panels 20*a*', 20*b*' and the respective outer and inner front panels 18*a*', 18*b*'. It should be noted that the inner and outer designations for the blank is different when they in the folded or unfolded position. For example, an inner panel in folded position is designated outer panel when in unfolded position. The outer front panels 18*b*' includes three spaced apart third locking tabs 61*a*, 61*b*, and 61*c* that engaged with the corresponding slots 58*d*, 58*e*, 58*f* on the bottom wall 14' as discussed herein below. The bottom wall panel 14' is formed by intersection of respective fold lines 50*a*, 50*b* and fold lines 30*a*, 30*b* at right angle. The bottom wall 14' includes two spaced apart first rows of slots 58*a*, 58*b*, 58*c*, and 58*d*, 58*e*, 58*f* each of which is formed near the respective fold lines 50*a*, and 50*b*. Similarly, the two respective second slots 44*a*' and 44*b*' are formed near the respective fold lines 30*a* and 30*b*. The inner back wall panel 20*b*' is foldably joined to one of the longitudinal edges of the bottom wall panel 14' and the inner front panel 18*a*' is foldably joined to the other longitudinal edges of the bottom wall panel 14'. Moreover, the inner back wall panel 20*b*' includes the first locking tabs 42' which are formed by the U-shaped cut 40*a* and nicks 40*b* and each of which is configured on respective lateral edges of the inner back wall panel 20*b*'. The two respective outer exterior flaps 38*a*', 38*b*' are attached to the respective lateral edges of the outer back wall panel 20*b*' via three nicks 40*b*. The outer back wall panel 20*a*' is foldably joined to the inner back wall panel 20*b*' by a double fold lines 52. A slot 54 is formed on the double fold lines 52, which is used to receive the graphic header 12 when the adjustable display tray 10 is fully constructed. The outer back wall panel 20*a*' includes a pair of back swing flap panels 34*a*', 34*b*' each of which foldably extends from lateral respective lateral edges thereof. Each of the back swing flap panels 34*a*', 34*b*' includes the respective second locking tab 46*a*', 46*b*'. The outer back wall panel 20*a*' further includes three space apart fourth locking tabs 60*a*, 60*b*, and 60*c* that are formed on its free edge which each of them engages with the respective slots 58*a*, 58*b*, and 58*c* when the blank is fully constructed.

As noted above, the first and second reducible or expandable sections 28*a*, 28*b* are mirror images of one another with respect to the lateral axis of the blank B1 and therefore the elements and description of first reducible or expandable sections 28*a* is exactly the same as the second reducible or expandable sections 28*b*. The first reducible or expandable section 28*a* comprises a back swing flap panel 34*a*', an outer exterior flaps 38*a*', an intermediate side wall panel 62*a*', a side wall panel 16*a*' (in reducible configuration), an exterior side wall panel 24*a*' (in expandable configuration), an interior side wall panel 64*a*' (in expandable configuration), an intermediate flap panel 66*a*, and front extension outer and inner flaps 18*c* and 18D. The side wall panel 16*a*' is part of the adjustable interior space 22 when the display tray 10 is in the fully expandable configuration. The back swing flap panel 34*a*' is foldably joined to the outer back wall panels 20*a*' via fold line 36*a*. The outer exterior flap 38*a*' is foldably joined to the side wall panel 16*a*' via fold line 74*a* and to the intermediate side wall panel 62*a*' via fold line 76*a*. The intermediate side wall panel 62*a*' is separated from the exterior side wall panel 24*a*' by cut line 78*a*, and panel 24*a*' is foldably joined to the interior side wall panel 64*a*' via a fold line 80*a*. The interior side wall panel 64*a*' includes two spaced apart fifth locking tabs 68*a*', 68*b*' each of which extends from one of the free edges thereof. The side wall panel 16*a*' includes two space apart third slots 70*a*, 70*b* formed on one of its longer sides and two fourth slots 72*a*, 72*b* each of which formed on its respective shorter sides. The third slots 70*a*, 70*b* are used to receive the respective fifth locking tabs 68*a*' and 68*b*' when the interior side wall panel 64*a*' is folded over the exterior side wall panel 24*a*' with intermediate side wall panel 62*a*' sandwiched therebetween and then positioned at right angle with respect to the side wall panel 16*a'*.

An intermediate flap 66*a* foldably extends from one end of the exterior side wall panel 24*a*' via fold line 82*a*. The front extension inner flap 18*c* foldably extends from the side wall panel 16*a*' via fold line 84*a*. The outer front extension flap 18*d* foldably extends from inner front extension flap 18*c* via fold line 86*a*. The front extension inner and outer flaps 18*c* and 18D are part of the first and second reducible or expandable sections 28*a*, 28*b* when the blank is fully constructed. The outer flap 18D includes a sixth locking tab 63*a* which is inserted into the slot 72*b* when the inner flap 18D is in folded position. In fact, the intermediate flap 66*a* is sandwiched between the front extension inner and outer flaps 18*c* and 18D when these two flaps are in overlapping relationship. The first reducible or expandable section 28*a* includes a triangularly-shaped tray front hinges 32*a*' formed by two fold lines 48*a*', 48*b*'. The triangularly-shaped tray front hinges 32*a*', the back swing flap panels 34*a*', and the fold line 30*a* in cooperation with one another permits the open-top of adjustable interior space 22 to be contracted as products are removed from the adjustable display tray. The contracted configuration of adjustable display tray 10 provides more valuable space on the shelf in a retail store so that the retailer may use it for other merchandise.

The second reducible or expandable section 28*b* comprises a back swing flap panel 34*b*', an outer exterior flaps 38*b*', an intermediate side wall panel 62*b*', a side wall panel 16*b*' (in reducible configuration), an exterior side wall panel 24*b*' (in expandable configuration), an interior side wall panel 64*b*' (in expandable configuration), an intermediate flap panel 66*b*, and front extension inner and outer flaps 18*e* and 18*f*. The side wall panel 16*b*' is part of the adjustable interior space 22 when the adjustable display tray 10 is in the fully expandable configuration. The back swing flap panel 34*b*' is foldably joined to the outer back wall panel 20*a*' via fold line 36*b*. The outer exterior flaps 38*b*' is foldably joined to the side wall panel 16*b*' via fold line 74*b* and the intermediate side wall panel 62*b*' is joined to flap 38*b*' via fold line 76*b* and separated from the exterior side wall panel 24*b*' by cut line 78*b*. Panel 24*b*', in turn, is foldably joined to the interior side wall panel 64*b*' via fold line 80*b*. The interior side wall panel 64*b*' includes two spaced apart third locking tabs 68*c*', 68*d*' each of which extends from one of the free edges thereof. The side wall panel 16*b*' includes two space apart third slots 70*c*, 70*d* formed on one of its longer sides and two fourth slots 72*c*, 72*d* each of which formed on its respective shorter sides. The third slots 70*c*, 70*d* are used to receive the respective third locking tabs 68*c*' and 68*d*' when the interior side wall panel 64*b*' is folded over the exterior side wall panel 24*b*' with intermediate side wall panel 62*b*' sandwiched therebetween and then positioned at right angle with respect to the side wall panel 16*b*'. An intermediate flap 66*b*' foldably extends from one end of the exterior side wall panel 24*b*' via fold line 82*b*. The front extension inner flap 18*e* foldably extends from the side wall panel 16*b*' via fold line 84*b*. The outer front extension flap 18*f* foldably extends from inner front extension flap 18*e* via fold line 86*b*. The front extension inner and outer flaps 18*e* and 18*f* are part of the first and second reducible or expandable sections 28*a*, 28*b* when the blank B1 is fully constructed. The outer flap 18*f* includes a sixth locking tab 63*b* which is inserted into the slot 72*d* when the outer flap 18*f* is in folded position. In fact, the intermediate flap 66*b* is sandwiched between the front extension inner and outer flaps 18*e* and 18*f* when these two flaps are in overlapping relationship.

Figure 8:
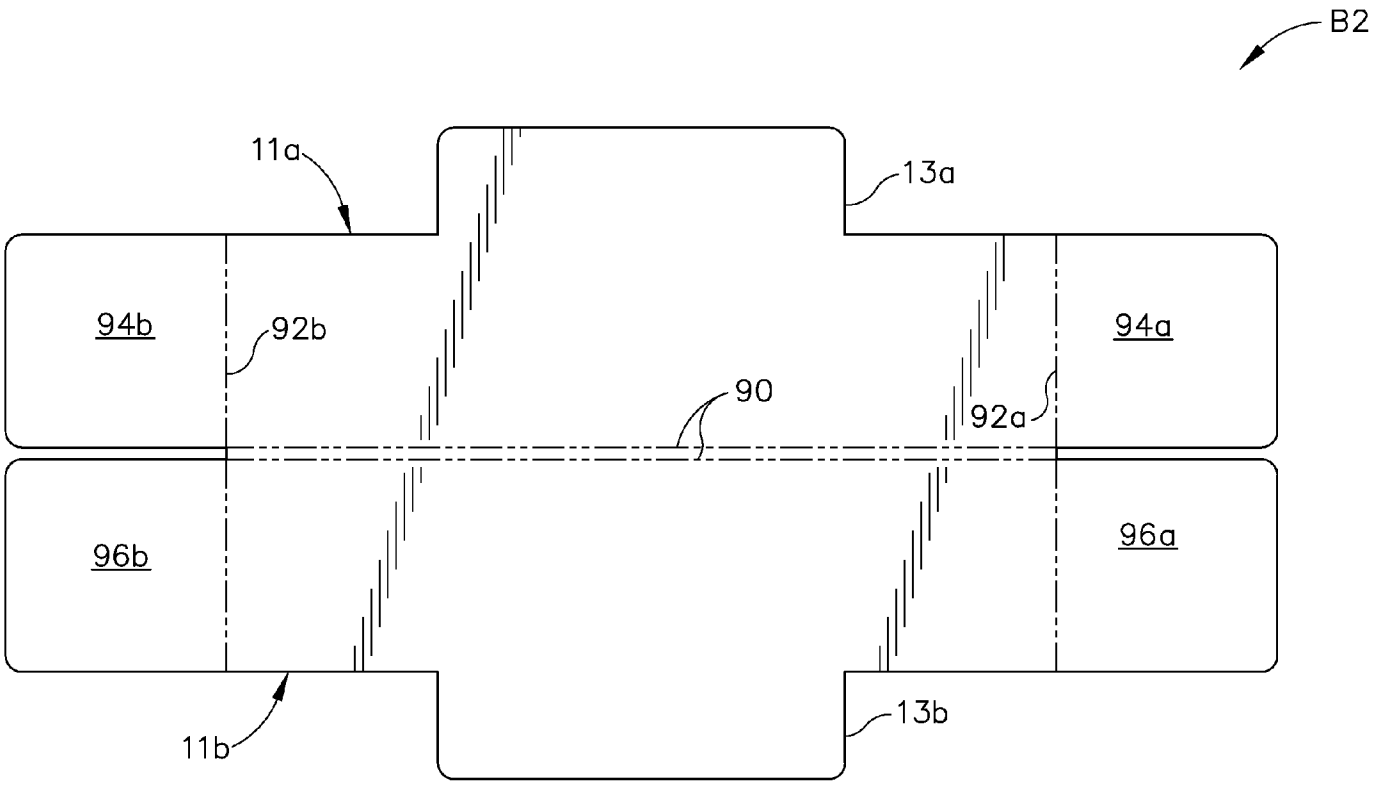
FIG. 8 is a top plan view of a blank for making the graphic header shown in FIG. 1.

FIG. 8 is a top plan view of a blank B2 for making the graphic header 12 shown in FIG. 1. The blank B2 is substantially flat symmetrical with respect to its longitudinal axis thereof. The blank B2 is preferably an integral piece of a material such as continuous sheet of conventional corrugated paperboard. The blank B2 is cut along its outer margins to form its specific shape. The blank B2 is divided into two overlapping graphic header panels 11*a*, 11*b* by two closely formed parallel fold lines 90. The graphic header panels 11*a*, 11*b* are symmetric with respect to fold lines 90. Each of graphic header panels 11*a*, 11*b* includes a respective insert tabs 13*a*, 13*b* that integrally extends from respective longitudinal edges thereof. Furthermore, each of respective graphic header panels 11*a*, 11*b* includes a respective pair of ear flaps 94*a*, 94*b* and 96*a*, 96*b* each of which foldably extend from respective lateral edges via respective fold lines 92*a*, 92*b*. Each of the ear flaps 94*a*, 94*b*, 96*a*, 96*b* is sized and shaped so that it corresponds to the size and shape of the outer exterior flaps 38*a*, 38*b* and the back swing flaps 34*a*, 34*b*. In the fully expanded configuration, the of ear flaps 94*a*, 96*b* are coextensively folded onto one another and the pair of ear flaps 94*b*, 96*b* are coextensively folded onto one another. The respective ear flaps 94*a*, 96*b* and 94*b*, 96*b* rest on the corresponding edges of the outer exterior flaps 38*a*, 38*b* and the back swing flaps 34*a*, 34, while the respective insert tabs 13*a*, 13*b* are coextensively folded onto one another and inserted into the slot 54. In the contracted configuration of the adjustable display tray 10, the respective pair of ear flaps 94*a*, 94*b* and the respective pair of ear flaps 96*a*, 96*b* are folded inwardly toward one another to reduce the length of the of the graphic header 12 so that the graphic header 12 correspond to the length of the adjustable display tray 10.

The manual set-up of the blank B1 to form the adjustable display tray 10 is easily accomplished. However, one of ordinary skill in the art would appreciate that generally a folding machine may alternatively perform the forming operations. The blank B1 is laid horizontally and the inner and outer back wall panels 20*a*, 20*b* are folded at right angle with respect to the fold line 50*a* and one edge of the intermediate wall panel 62*a*' is positioned on the longer side of the side wall panel 16*a*'. Next, the interior and exterior side wall panels 64*a*', 24*a*' are folded upwardly so that the exterior wall panel 24*a*' is in overlapping relationship with the intermediate wall panel 62*a*' while the interior side wall panel 64*a*' is folded over the intermediate wall panel 62*a*' such that the intermediate wall panel 62*a*' is sandwiched or concealed between the interior and exterior side wall panels 64*a*', 24*a*' and finally the respective third locking tab 68*a*, 68*b* are inserted into respective third slots 70*a*. 70*b*. Similarly, the intermediate wall panel 62*b*' is positioned on the longer side of the side wall panel 16*b*'. Next, the interior and exterior side wall panels 64*b*', 24*b*' are folded upwardly so that the exterior wall panel 24*b*' is in overlapping relationship with the intermediate wall panel 62*b*' while the interior side wall panel 6*ba*' is folded over the intermediate wall panel 62*b*' such that the intermediate wall panel 62*b*' is sandwiched or concealed between the interior and exterior side wall panels 64*b*', 24*b*' and finally the respective fifth locking tab 68*c*, 68*d* are inserted into respective third slots 70*c*. 70*d*. Now, the inner back wall 20*a*' folds over the outer back wall panel 20*b*' in an overlapping relationship such that Inner and outer back wall panels 20*a*', 20*b*' and the respective back swing flaps 34*a*', 34*b*, the respective outer exterior flaps 38*a*', 38*b*' are all coextensive with one another and finally the fourth locking tabs 60*a*, 60*b*, 60*c* are inserted into the corresponding slots 58*a*, 58*b*, 58*c*. At the same time, the respective second locking tabs 46*a*', 46*b*' are inserted to the corresponding fourth slots 72*a*, 72*c*. Next, the respective intermediate flap panel 66*a*, 66*b* are folded at right angle with respect to the side wall 16*a*, 16*b* and then simultaneously the front extension outer flaps 18D, 18*f* and outer front panel 18*b* are folded upwardly and folded over their respective inner flap panels 18*c*, 18*e*, and outer front panel 18, respectively. In the folded position, the respective intermediate flap panel 66*a*, 66*b* are sandwiched and concealed between the front extension inner and outer flap panels 18*c*, 18*d*, 18*e*, and 18*f*. Finally, the third locking tabs 61*a*, 61*b*, and 61*c* are inserted into the corresponding slots 58*d*, 58*e*, and 58*f* which complete the folding sequence for construction of the blank B1. As noted above, for construction of Blank B2, the graphic header panels 11*a*, 11*b* are folded onto one another along the fold line 90, and then the insert tab 13 that is defined by insert tab panels 13*a*, 13*b* is pushed into the slot 54. The graphic header 12 is used to print on it various indicia or advertizing materials.

Figure 5:
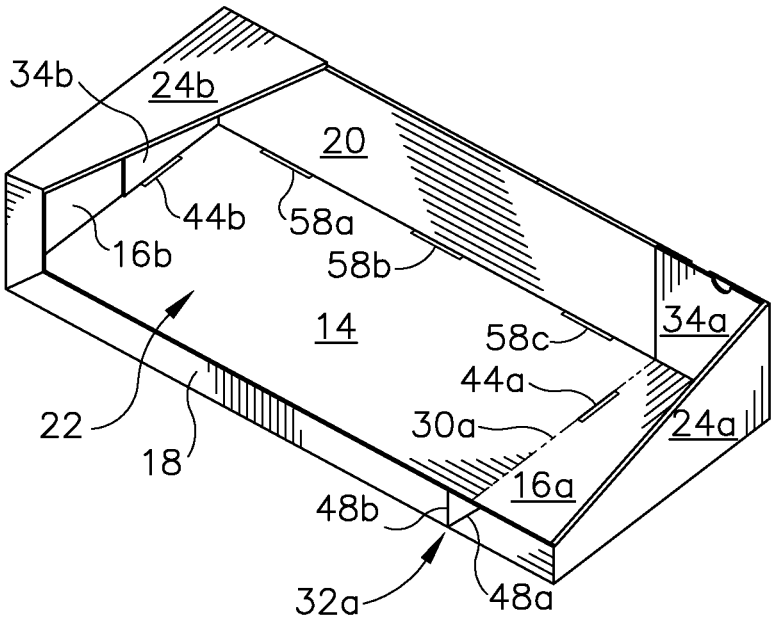
FIG. 5 illustrates the top perspective view of the expandable tray of FIG. 4 in which one of the reducible or expandable sections is in a contracted configuration and the other one is in expanded configuration.

In use, in the expanded configuration, the various products are disposed into the adjustable display tray 10 and the display tray is transported into a retail store and the retailer places it on a display shelf or rack. As products are removed by customers from the adjustable display tray 10, the retailer can then fold the first or second reducible/expandable sections 28*a*, 28*b* so as to provide valuable extra space on the shelf for other adjacent products. To fold the first or second reducible/expandable sections 28*a*, 28*b*, each of the back swing flaps 34*a*', 34*b* are position at the right angle with respect to the respective outer exterior flaps 38*a*', 38*b*', then split each of the outer exterior flaps 38*a*', 38*b*' from inner back wall panel 20*b* by breaking the nicks 40*b* and slightly push the exterior flaps 38*a*', 38*b*' towards the rear to dislocate first or second reducible/expandable sections 28*a*, 28*b*. Finally, each of the first or second reducible/expandable sections 28*a*, 28*b* can be folded toward the interior of the tray to reduce the adjustable interior space 22. One of the advantages of the adjustable display tray 10 is that the first or second reducible/expandable sections 28*a*, 28*b* can be independently contracted or expanded with respect to one another as seen best in FIG. 5. For example, as products removed from the interior space 22, the retailer may reduce the interior space 22 by folding inwardly one of the first or second reducible/expandable sections 28*a*, 28*b* to provide more space on the shelf for retailer to be used for other merchandizes. As noted above, the central section 26 has a length which is at least twice as long as respective length of each of the first and second reducible or expandable sections 28*a*, 28*b*. Alternatively, the adjustable display tray 10 can also receive products or articles when it is in contracted configuration and then be transported to a retail store and then be expanded to contain more or other merchandizes. The adjustable display tray 10 provides various flexibilities to the retailers with respect to their valuable shelf space for displaying products for sell.

It should now be appreciated that the present invention provides a material-saving, quickly erected display tray especially useful in retaining, transporting variety of products to retail stores. The adjustable display tray 10 is designed with a central section 26 formed by two parallel spaced apart fold lines 30*a*, 30*b* on the bottom wall 14 and respective central portions of the front wall and back wall and respective first and second reducible or expandable sections 28*a*, 28*b* each of which foldably extends from the respective two parallel spaced apart fold lines. As described above, the structure of the respective first and second reducible or expandable sections provide more space on the shelf for retailer to be used for other merchandizes and enhance the rigidity, stackability, and manufacturing cost effectiveness of the adjustable display tray 10. The blank B1 used to form the display tray has a symmetrical design, which reduces erecting and closing labor. The lay flat design of the blank B1 speeds the cutting and packaging process and facilitates easy shelving.

Numerous modifications and variations on the present invention are possible in light of the above teachings. It is, therefore, to be understood that within the scope of the accompanying claims, the invention may be practiced otherwise than as specifically described herein.

It should be understood that fold lines and score line as used herein may be used interchangeably so long as the function of the line is not destroyed.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An adjustable display tray convertible between expanded and contracted configurations by a retailer at a point of sale to provide the retailer with the flexibility of using the adjustable display tray as a stock-keeping unit in an expanded or a contracted configuration, said tray comprising:

a bottom wall having a front edge, a back edge and opposite side edges;

a front wall folded upwardly from said bottom wall front edge;

a back wall comprising an outer back wall panel folded upwardly from said bottom wall back edge, and an inner back wall panel foldably joined to a top edge of said outer back wall panel and folded inwardly and downwardly against an inner surface of said outer back wall panel;

opposite side walls folded upwardly from opposite side edges of said bottom wall, said side walls being foldable independently of one another into either an expanded or contracted configuration, said side walls each comprising a first side panel foldably joined along a first edge to a respective side edge of said bottom wall, and a second side panel foldably joined to said first side panel along an edge thereof opposite said first edge, wherein said first side panels have a first position extending perpendicular to said bottom wall and forming outer side wall panels in the contracted configuration of said tray and have a second position extending parallel to said bottom wall and forming extensions of said bottom wall in the expanded configuration of said tray, and wherein said second side panels have a first position folded inwardly from a top edge of a respective said first side panel to lie in spaced parallel relationship to said bottom wall and form a partial top cover for said tray when the tray is in a contracted configuration and have a second position folded upwardly from said first side panel to form an outer side wall when the tray is in an expanded configuration;

an outer exterior flap joined along a frangible line to respective opposite ends of said outer back wall panel and joined along a fold line to an adjacent end of an associated said first side panel, wherein said outer exterior flaps have a first position separated along said frangible lines from said outer back wall panel and extending parallel to said first side panel and perpendicular to said outer back wall panel when said tray is in its contracted configuration, and a second position joined to and extending coplanar from the ends of said outer back wall panel and perpendicular to respective said first side panels when the tray is in its expanded configuration; and a back swing flap foldably joined to each of opposite ends of said inner back wall panel, wherein said back swing flaps have a first position folded inwardly against an inner surface of a respective said first side panel when the tray is in a contracted configuration and a second position lying against a respective adjacent outer exterior flap when the tray is in an expanded configuration.

2. The adjustable display tray of claim 1 further comprising a removable graphic header configured to be attached to central portion of the back wall.

3. The adjustable display tray of claim 1 wherein the back wall has a height (H) and the front wall has a height (h) and wherein the height (h) of the front wall is less than the height (H) of the back wall so as to allow for ease in viewing of the articles stored in the display tray.

4. The adjustable display tray of claim 1 wherein said frangible lines joining said outer exterior flaps to respective opposite ends of said outer back wall panel comprise a U-shaped cut and nicks.

5. The adjustable display tray of claim 4 wherein a first locking tab is formed by the respective U-shaped cut of each of the respective outer exterior flaps.

6. The adjustable display tray of claim 1 wherein a slot is formed proximate each of the opposite side edges of the bottom wall.

7. The adjustable display tray of claim 6 wherein each of the back swing flaps includes a guide tab inserted into a respective said slot proximate each of the opposite side edges of the bottom wall.

8. The adjustable display tray of claim 1 wherein the bottom wall has a length (L1) which is at least three times longer than the respective lengths (L2) of each of the first and second side panels.

9. The adjustable display tray of claim 1 wherein the bottom wall has a length (L1) which is at least twice as long as the respective lengths (L2) of each of the first and second side panels.

10. The adjustable display tray of claim 1 wherein the front wall is joined to respective opposite said side walls by triangularly shaped webs forming hinges defined by two fold lines.

11. An adjustable display tray capable of being converted from an expanded configuration to a contracted configuration comprising:

a bottom wall having two parallel spaced apart fold lines;

opposite side walls foldably joined to respective lateral edges of the bottom wall;

a front wall foldably joined to a first longitudinal edge of the bottom wall, the front wall including two spaced apart tray front hinges;

a back wall foldably joined to a second longitudinal edge of the bottom wall, the back wall being defined by an inner back wall panel and an outer back wall panel foldably joined to one another, wherein the inner back wall panel includes two parallel laterally spaced apart score lines to form two back swing flaps, and an outer exterior flap is joined to each end of the outer back wall panel along a frangible line, and wherein the bottom wall, opposite side walls, the front wall and the back wall are foldably joined to one another to form an open-top adjustable interior space for containing articles, wherein the adjustable interior space includes:

a central section formed by the two parallel spaced apart fold lines and respective central portions of the front wall and back wall; and respective first and second sections reducible and expandable independently of one another, each of said first and second section being formed by the two parallel spaced apart fold lines, the two respective tray front hinges, the two respective back swing flaps and the two respective outer exterior flaps, all of which engage with one another to permit the respective first and second reducible or expandable sections reducing or expanding the interior space of the adjustable display tray.

12. The adjustable display tray of claim 11 wherein the back swing flaps and the outer exterior flaps are in overlying parallel registry with one another when the display tray is in expanded configuration.

13. A blank for making an adjustable display tray capable of being converted from an expanded configuration to a contracted configuration, the blank comprising:

a bottom wall panel having two parallel spaced apart fold lines and two space apart slots formed in proximity of the respective spaced apart fold lines, opposite side wall panels foldably joined to respective lateral edges of the bottom wall panel, a front wall panel foldably joined to a first longitudinal edge of the bottom wall panel, the front wall panel being defined by an inner front wall panel and an outer front wall panel foldably joined to one another, the outer front wall panel including two triangularly-shaped webs that form tray front hinges, a back wall panel foldably joined to a second longitudinal edge of the bottom wall panel, the back wall panel being defined by an inner back wall panel and an outer back wall panel foldably joined to one another, wherein a back swing flap is defined at each end of the inner back wall panel by two parallel laterally spaced apart score lines, and an outer exterior flap is foldably joined at a frangible score line to each end of the outer back wall panel, said tray having a central section formed by the two parallel spaced apart fold lines and by respective central portions of the front wall panels and back wall panels, and first and second reducible and expandable sections defined by the two parallel spaced apart fold lines, the two tray front hinges, the two back swing flaps and the two outer exterior flaps, all of which engage with one another to permit the first and second reducible and expandable sections to contract or to expand the adjustable display tray.

* * * * *